US006677838B2

(12) United States Patent
Ferling

(10) Patent No.: US 6,677,838 B2
(45) Date of Patent: Jan. 13, 2004

(54) COPLANAR WAVEGUIDE WITH A LOW CHARACTERISTIC IMPEDANCE ON A SILICON SUBSTRATE USING A MATERIAL WITH A HIGH DIELECTRIC CONSTANT

(75) Inventor: Dieter Ferling, Stuttgart (DE)

(73) Assignee: Avanex Corporation, Fremont, CA (US)

( * ) Notice: Subject to any disclaimer, the term of this patent is extended or adjusted under 35 U.S.C. 154(b) by 0 days.

(21) Appl. No.: 10/115,925

(22) Filed: Apr. 5, 2002

(65) Prior Publication Data

US 2002/0153974 A1 Oct. 24, 2002

(30) Foreign Application Priority Data

Apr. 21, 2001 (DE) ..... 101 19 717

(51) Int. Cl.[7] ..... H01P 3/08

(52) U.S. Cl. ..... 333/238; 333/157; 333/239; 333/248

(58) Field of Search ..... 333/157–159, 333/238–241, 248–259

(56) References Cited

U.S. PATENT DOCUMENTS 4,216,450 A * 8/1980 Linke et al. ..... 333/248

* cited by examiner

*Primary Examiner*—Kenneth B. Wells
(74) *Attorney, Agent, or Firm*—Kenta Suzue; Wilson Sonsini Goodrich & Rosati

(57) ABSTRACT

A coplanar waveguide, which has parallel conductor strips that are arranged on a substrate and have an electrically insulating intermediate space between one another, wherein a material with a high dielectric constant is arranged on the conductor strips, on their side facing away from the substrate. In this way, it is possible to achieve a line section with a relatively small characteristic impedance.

13 Claims, 1 Drawing Sheet

COPLANAR WAVEGUIDE WITH A LOW CHARACTERISTIC IMPEDANCE ON A SILICON SUBSTRATE USING A MATERIAL WITH A HIGH DIELECTRIC CONSTANT

BACKGROUND OF THE INVENTION

The invention is based on a priority application 101 19 717.9 which is hereby incorporated by reference.

The invention relates to a coplanar waveguide, which has parallel conductor strips that are arranged on a substrate and have an electrically insulating intermediate space between one another.

In coplanar waveguides which are formed by striplines, the characteristic impedance depends on the distance between the conductor strips. In one case, however, for instance the case below, it is not possible to achieve the small distance required for a desired low characteristic impedance. On silicon submounts of laser modules for a transmission rate of 10 Gbit/second, it is necessary to have a circuit to compensate for the stray capacitance of the laser, in order to increase the bandwidth. In the case of coplanar thin-film technology, this compensation circuit requires a short transmission line with a low (characteristic) impedance of e.g. 15 ohms. A low impedance of this type cannot be achieved in the form of a coplanar waveguide: because of the small intermediate spaces which would be needed between the conductor strips, it would be necessary to go below the smallest technically feasible distance (critical distance).

It is an object of the invention, for a device of the type described in the introduction, to offer a way of providing a line section with a low impedance by using simple means.

SUMMARY OF THE INVENTION

This object is achieved, according to the invention, by arranging a material with a high dielectric constant on the conductor strips, on their side facing away from the substrate.

Preferably, the material with a high dielectric constant is held in close contact with the conductor strips, so that any air gaps can be kept very small and the arrangement is well defined.

The material with a high dielectric constant, which may be any suitable material in any suitable form, and may preferably be a piece of ceramic and, in particular, may be in the form of a plate, has a dielectric constant which is high enough to obtain a capacitance that is sufficiently high for a low characteristic impedance. In one example, the relative permittivity =65 in order to create the desired relatively low characteristic impedance in the vicinity of the plate, or the ceramic piece, in the coplanar line. This low characteristic impedance owes its existence to the fact that the ceramic piece increases the effective capacitance between the conductors of the coplanar line, compared with the situation in which the ceramic piece is not present. The ceramic piece is fastened onto the top of the conductors of the coplanar line, that is to say the conductors of the coplanar line are situated between the substrate of this line, which e.g. consists of (high-resistivity) silicon, and the ceramic piece. In other applications, it may be possible to use a material with a relative permittivity of only about 10 in order to increase the capacitance.

In one embodiment of the invention, the side of the material with a high dielectric constant facing away from the conductor strips is designed to be electrically conductive, and is preferably provided with a metallisation. The advantage of this is that the metallisation enhances the capacitance-increasing effect of the ceramic piece, specifically because the field strength in the ceramic piece is increased by shortening the field lines.

In one embodiment of the invention, the length over which the material with a high dielectric constant is applied, or the length of the material with a high dielectric constant, is shorter than the 4. Waveguide according to one of the preceding claims, wherein the length over which the material with a high dielectric constant is applied, or the length of the material with a high dielectric constant, is shorter than the stripline. Here, a lower characteristic impedance is hence present over a limited part of the length of the stripline.

BRIEF DESCRIPTION OF THE DRAWINGS

Other features and advantages of the invention are presented in the following description of exemplary embodiments of the invention with reference to the drawing, which shows details that are essential to the invention, and in the claims. The individual features may each be implemented on their own, or several of them may be combined in an embodiment of the invention.

Figure 3:
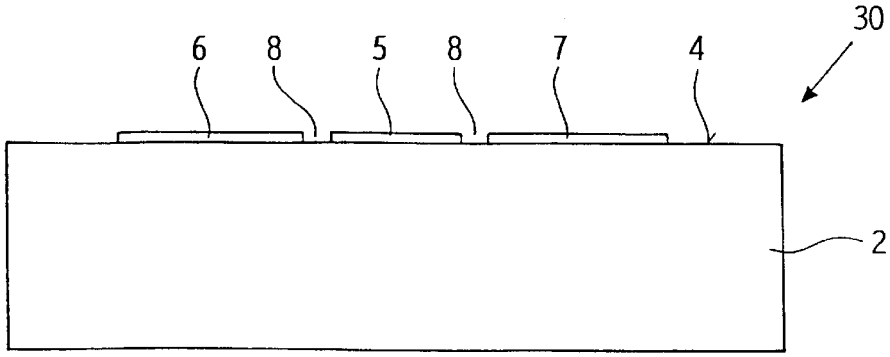
FIG. 3 shows a cross section through a known arrangement.

The known arrangement 30 according to FIG. 3 has a substrate 2 made of high-resistivity silicon, which may alternately consist of aluminium oxide ($Al_2O_3$). Conductor strips 5, 6 and 7 running parallel to one another are arranged in a plane (coplanar) on the upper side 4 of the substrate 2, the conductor strip 5 lying between the other two conductor strips. The conductor strips 5, 6 and 7 in the example (which are formed by metal strips) form a stripline together with the substrate 2, the conductor strips 6 and 7 usually forming the outer conductors. There is an intermediate space 8 between the central conductor strip 5 and each of the other two conductor strips. This space may be reduced down to a critical distance, depending on the fabrication process. Therefore, with otherwise unchanged dimensions and properties of the materials which are used, the capacitance per unit length between the conductors cannot be increased beyond a certain amount.

Figure 1:
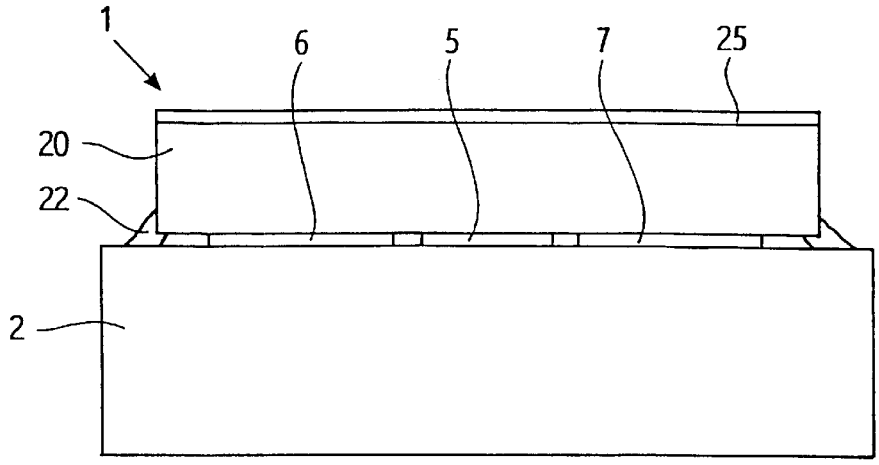
FIG. 1 shows a cross section through an exemplary embodiment of a coplanar line according to the invention, a ceramic piece being used which has a metallisation on its side facing away from the lines of the stripline.

The exemplary embodiment of the invention shown in FIG. 1 is a waveguide 1, which only differs from the arrangement according to FIG. 3 by the fact that a ceramic piece 20, which protrudes laterally beyond the strips, is placed and fastened on the side of the conductor strips 5 to 7 facing away from the substrate 2. The fastening is carried out by adhesive bonding in the example, for which purpose adhesive 22 in the edge region of the ceramic piece 20 joins the latter to the upper side of the substrate 2. In the example shown in FIG. 1, a back metallisation 25 is furthermore applied to the side of the ceramic piece 20 facing away from the conductor strips 5, 6 and 7. Here again, the substrate 2 consists of high-resistivity silicon, although in other embodiments it may consist of $Al_2O_3$.

In another exemplary embodiment of the invention, which is not shown in the drawing, the metallisation 25 is omitted.

The ceramic piece 20 consists at least substantially (exclusively, in the case of the example) of a ceramic material with a high relative permittivity, which has the value 65 in the example. The dielectric constant of the ceramic piece is therefore 65 multiplied by the permittivity of free space.

The ceramic piece 20 increases the effective capacitance between the conductor strips 5, 6 and 7, compared with the situation without any ceramic piece 20. If the metallisation 25 is not present, then the field lines propagate from the central conductor strip to the two outer conductor strips 6 and 7, while being curved inside the ceramic piece 20 in the form of the known electric field lines, that is to say with a significant component in the horizontal direction in FIG. 1. The field lines therefore have a relatively large length.

If, however, the metallisation 25 is applied to the upper side of the ceramic piece 20, then the field lines inside the ceramic piece propagate from each of the individual conductor strips 5, 6 and 7 largely at right angles to the plane of the arrangement of the lines 5 to 7, that is to say in a direction perpendicular to the plane of the metallisation in FIG. 1 because, as a rough approximation, the metallisation 25 has the same potential over its width in the cross-sectional plane which is shown. It is clear to the person skilled in the art that, if the ceramic piece has a very large thickness (or if the metallisation is at a large distance from the plane of the conductor strips), the effect of the metallisation 25 is no longer observable. Especially with fairly small thicknesses of the ceramic piece 20, which can still be produced without problems and can be handled reliably, the metallisation 25 can provide a significant increase in the achievable capacitance because the field lines are shortened, as described above, compared with the case in which the metallisation 25 is absent.

In both of the exemplary embodiments described with the aid of FIG. 1, almost none of the adhesive 22 lies in the electric field, so that it is not necessary to ensure particular RF properties of the adhesive, e.g. small dielectric losses. Nevertheless, it is also possible to apply adhesive between the substrate and the ceramic piece, although this must be taken into account in terms of the electrical behaviour.

Figure 2:
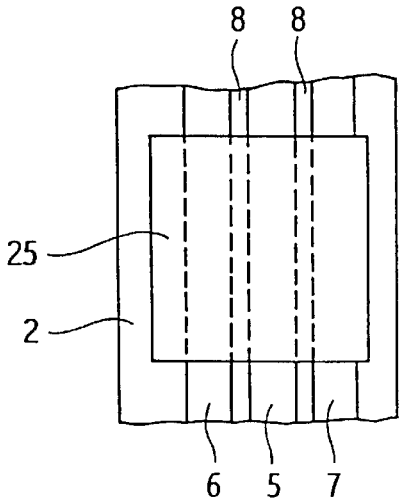
FIG. 2 shows a plan view of the arrangement according to FIG. 1, cut away.

As shown in FIG. 2, the length of the ceramic plate 2 is limited, so that it causes a reduction in the characteristic impedance only over a limited length range of the stripline.

In the described examples, the ceramic piece is a plane-parallel plate which causes a sudden jump of the characteristic impedance in the line. If a gradual change in the characteristic impedance is desired, this can be obtained by chamfering the end edges of the ceramic piece (hence forming a wedge angle towards the upper side of the ceramic piece) and/or by tapering the width of the metallisation (in the horizontal direction in FIG. 1) or, similarly, advantageously in an inventive way.

A particular advantage of the invention is that the fabrication is straightforward, specifically because the ceramic piece can be fastened in the same way as the other components, e.g. by adhesive bonding. The technology used for producing the substrate does not therefore need to be modified in such a way as to create a complicated process, e.g. having to employ thin-film multilayer technology.

In the example of FIG. 1, the following dimensions and other data are selected: Length, width and thickness of the substrate 2:6 mm×3 mm×0.5 mm, Length, width and thickness of the ceramic piece 20:1.2 mm×0.8 mm×0.1 mm, Material of the ceramic piece: product H09CG060EXNX from Dielectric Laboratories Inc., at Cazenovia, N.Y. 13035, USA, Thickness and material of the metallisation 25:1 $\mu$m gold, Thickness, width, material of the striplines 5, 6, 7:7.1 $\mu$m×100 $\mu$m gold, although the outer striplines could be wider.

Instead of fastening the ceramic piece (ceramic plate) by adhesive bonding, it may advantageously be provided on its lower side with strip-like metallisations which are flush with the conductor strips. The ceramic plate configured in this way is placed with an accurate fit on the strip conductors, and is joined to them by soldering or welding.

What is claimed is:

1. A coplanar waveguide comprising:

a substrate;

a plurality of parallel conductor strips having a first side and second side, said first side of said conductor strips being arranged on said substrate; and an electrically insulating intermediate space provided between said conductor strips, wherein a unitary dielectric material contacts the second side of each of said conductor strips.

2. The waveguide according to claim 1, wherein the dielectric material contacts the conductor strips.

3. The waveguide according to claim 1, wherein a side of the dielectric material facing away from the conductor strips is electrically conductive.

4. The waveguide according to claim 1, wherein the length over which the dielectric material is applied, is shorter than the stripline.

5. The waveguide according to claim 1, wherein the dielectric material has a relative permittivity of at least 10.

6. The waveguide according to claim 1, wherein the relative permittivity is about 65.

7. The waveguide according to claim 1, wherein a side of the dielectric material facing away from the conductor strips is provided with a metallization.

8. The waveguide according to claim 1, wherein a side of the dielectric material facing away from the conductor strips is electrically conductive and is provided with a metallization.

9. The waveguide according to claim 1, wherein the relative permittivity is at least 65.

10. The waveguide according to claim 1, wherein the relative permittivity is above 10.

11. The waveguide according to claim 1, wherein the relative permittivity is at least 65.

12. The waveguide according to claim 1, wherein the conductor strip includes at least one chamfered edge.

13. The waveguide according to claim 12, wherein a V-shaped dielectric material is coupled to the conductor strips.

* * * * *